United States Patent [19]

Kasai

[11] Patent Number: 4,928,365

[45] Date of Patent: May 29, 1990

[54] BUCKLE

[75] Inventor: Kazumi Kasai, Namerikawa, Japan

[73] Assignee: Yoshida Kogyo K. K., Tokyo, Japan

[21] Appl. No.: 370,717

[22] Filed: Jun. 23, 1989

[30] Foreign Application Priority Data

Jun. 25, 1988 [JP] Japan ..... 63-84146[U]

[51] Int. Cl.[5] ..... A44B 11/25

[52] U.S. Cl. ..... 24/635; 24/625

[58] Field of Search ..... 24/635, 625, 615, 664, 24/163

[56] References Cited

U.S. PATENT DOCUMENTS 4,604,772 8/1986 Arff .
4,774,744 10/1988 Kasai .

FOREIGN PATENT DOCUMENTS 0245877 11/1987 European Pat. Off. .
2116673 7/1972 France .
60-31809 4/1985 Japan .
0343669 2/1931 United Kingdom ..... 24/635
0871819 7/1961 United Kingdom .
2150632 7/1985 United Kingdom .

*Primary Examiner*—Victor N. Sakran
*Attorney, Agent, or Firm*—Hill, Van Santen, Steadman & Simpson

[57] ABSTRACT

A buckle includes a male member having a tongue-shaped presser having on its lower side a pair of engaging legs and a female member including in its upper side an aperture for insertion of the engaging legs, and a pair of transversely spaced resilient arms adapted for angular movement around their proximal ends against their own resiliency, the arms having on their middles engaging means for engagement with the engaging legs when the engaging legs are forced through an aperture. Uncoupling means are rotatably mounted on the upper side of the female member and so operatively linked with the free ends of the resilient arms that the rotation of the uncoupling means causes the resilient arms angularly move against their own resiliency, thereby bringing the engaging means out of engagement with the engaging legs.

9 Claims, 4 Drawing Sheets

BUCKLE

BACKGROUND OF THE INVENTION

1. Field of the Invention

The present invention relates to a buckle for fastening a closure flap of a bag, a rucksack or the like, and also for fastening straps, belts or suspenders of a shoe, a boot, trousers, a skirt or the like.

2. Description of the Prior Art

Japanese Utility Model Laid-Open Publication No. 62-185510 discloses a buckle of the type described which buckle comprises, as shown in FIGS. 14, 15 and 16 of the accompanying drawings, interlocking male and female members A, D. The male member A comprises a tongue-shaped presser B having on its lower surface a pair of engaging legs C, C, which is engageable with the engaging edge E of an aperture in the female member D when the male member A is pressed against the female member B so as to force the legs C, C into the aperture from the upper side of the female member D in a snap action. The female member D has a pair of resilient arms F, F having a pair of inwardly directed pushing portions. When the two arms F, F are pressed toward each other, the pusher portions pushes the legs C, C so as to resiliently bend the same inwardly, thereby bringing the engaging legs C, C out of engagement with the engaging edge E of the aperture.

Since the conventional buckle is of the type that the arms F, F disposed on the opposite sides of the female member D must be gripped and compressed for the operation of uncoupling the male member A from the female member D, the uncoupling operation is difficult indeed where the underlying fabric piece is so soft that the female member D is partly embedded in such a soft fabric piece or where the female member D is thin and hence the resilient arms F, F and the grips provided thereon are much thinner.

With the foregoing drawback in view, it is an object of the present invention to provide a buckle wherein the uncoupling operation of the male member from the female member can be accomplished easily irrespective of whether the underlying fabric piece is hard or whether the female member is thick.

According to the present invention, there is provided a buckle comprising: a male member having a tongue-shaped presser having on its lower side a pair of engaging legs; a female member being in the form of a case and including in its upper side an aperture for insertion of the engaging legs, and a pair of transversely spaced resilient arms formed integrally to one end of the female member and terminating in free ends for angular movement around their proximal ends against their own resiliency, the arms having engaging means for engagement with the engaging legs when the engaging legs are forced through an aperture; and an uncoupling means for bringing the engaging means out of engagement with the engaging legs, the uncoupling means having a disk rotatably mounted on the upper side of the female member; the uncoupling means further including linking means for so operatively linking the disk and the resilient arms that the rotation of the disk causes the resilient arms angularly move against their own resiliency, thereby bringing the engaging means out of engagement with the engaging legs.

Many other objects, advantages and additional features of the present invention will become manifest to those versed in the art upon making reference to the detailed description and the accompanying sheets of drawings in which a preferred structural embodiment incorporating the principle of the present invention is shown by way of illustrative example.

DETAILED DESCRIPTION

Figure 1:
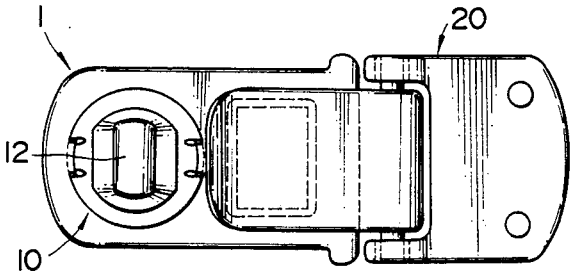
FIG. 1 is a plan view of a buckle embodying the present invention, showing a male and a female member of the buckle disposed in a coupled posture.
Figure 2:
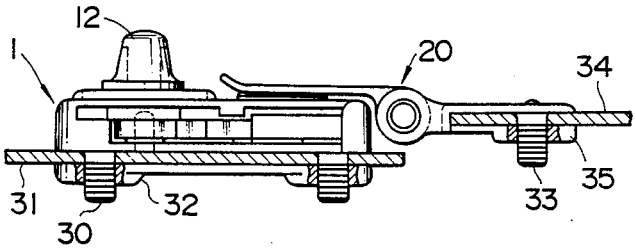
FIG. 2 is a side elevational view, partly in cross section, of FIG. 1.
Figure 3:
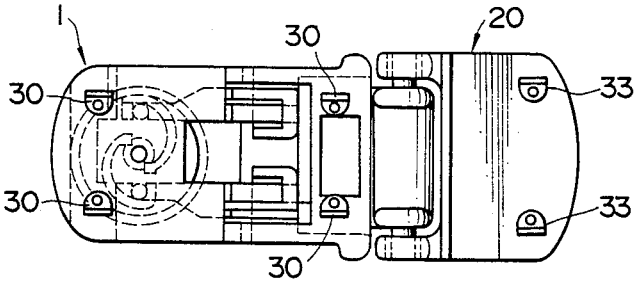
FIG. 3 is a bottom view of FIG. 1.

The principle of the present invention is particularly useful when embodied in a buckle such as shown in FIGS. 1 through 3.

The buckle broadly comprises a female member 1 (FIGS. 4 through 6), uncoupling means 10 (FIGS. 7 through 9) and a male member 20 (FIGS. 10 through 13). Each of the female member 1, the uncoupling means 10 and the male member 20 is molded of a synthetic resin such as polyacetal, nylon or polypropylene.

FIGS. 1 through 3 show the male member 20 band the female member 1 having the uncoupling means 10 mounted thereon as disposed in a coupled posture. FIG. 2 further shows the female member 1 and the male member 20 as attached to fabric pieces 31 and 34, respectively.

Figure 4:
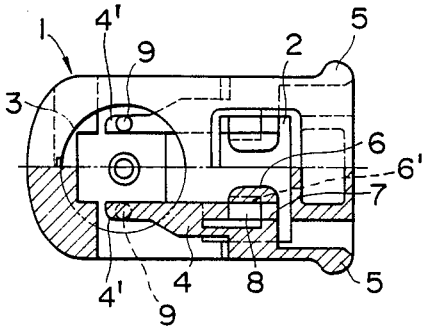
FIG. 4 is a plan view, partly in cross section, of the female member.
Figure 5:
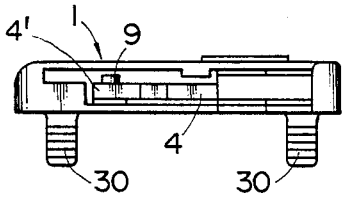
FIG. 5 is a side elevational view of FIG. 4.
Figure 6:
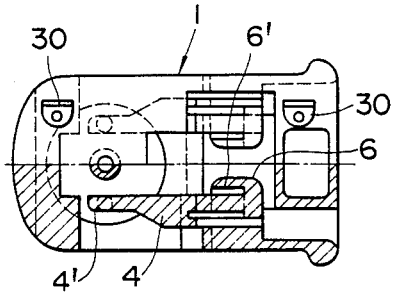
FIG. 6 is a bottom view, partly in cross section, of FIG. 4.

As better shown in FIGS. 4 through 6, the female member 1 is generally in the form of a case and has a rectangular aperture 2 and a circular aperture 3 formed in its upper side and disposed in juxtaposed relation to each other, the rectangular aperture 2 being adapted for insertion therethrough of a pair of engaging legs 24, 24 and a pair of resilient pieces 25, 25 both provided on the male member 20 which will be closely described hereinbelow. A pair of transversely spaced resilient arms 4, 4 are enclosed in the female member 1 and formed integrally to one end or the right end (as viewed in FIGS. 4 through 6) of the female member 1. The resilient arms 4, 4 extend in substantially parallel relation to each other and terminate in free ends 4', 4' so that the resilient arms 4, 4 may angularly move toward each other around the proximal ends 5, 5 under their own resiliency. As shown in FIG. 4, each of the resilient arms 4, 4 has on its middle on its inner side a hook-shaped engaging means 6, which projects inwardly therefrom and has its distal end portion 6' overhang over the inner side of the arm 4 to thereby define with the inner side of the arm 4 a space 8. There is also provided on the middle of the resilient arm 4 an abutment portion 7. The abutment portion 7 projects into the space 8 and is adapted to coact with the opposed abutment portion 7 of the other arm 4 to compress the resilient legs 24, 24 which are inserted into the spaces 8, 8 through the rectangular aperture 2, as will be closely described hereinbelow. Each arm 4 has a pin 9 at its free ends 4' on its upper side. The pin 9 is urged under the resiliency of the resilient arm 4 into sliding engagement with a concave side 16*s* of an arcuate cam ridge 16 of the uncoupling means 10, as closely described hereinbelow. As shown in FIG. 3, the female member 1 has on its lower side four studs 30, 30, 30, 30 which, as shown in FIG. 2, pass through a fabric piece 31 and are fastened at their distal ends to a base plate 32 for firm attachment of the female member 1 to the fabric pieced 31.

Figure 7:
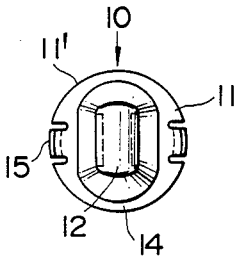
FIG. 7 is a plan view of uncoupling means of the buckle.
Figure 8:
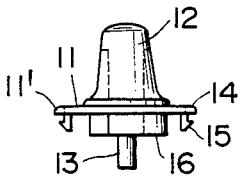
FIG. 8 is a side elevational view of FIG. 7.
Figure 9:
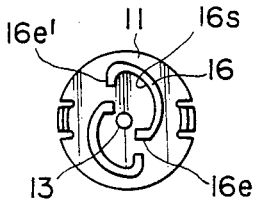
FIG. 9 is a bottom view of FIG. 7.
Figure 10:
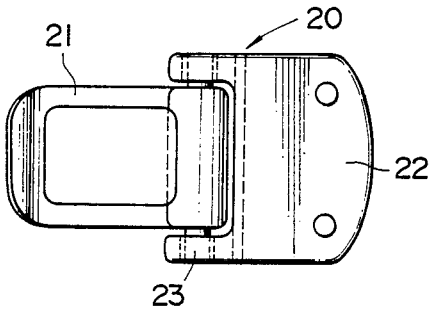
FIG. 10 is a plan view of the male member of the buckle.

As better shown in FIGS. 7 through 9, the uncoupling means 10 generally comprises a disk 11, a grip knob 12 provided on a upper side of the disk 11 for manipulation of the uncoupling means 10 and an arcuate cam ridge 16 provided on the lower side of the disk 11 for cooperation with the pin 9 of the female member 1 in the operation of uncoupling the male member 20 from the female member 1, as described more closely hereinbelow. As better shown in FIG. 8, the disk 11 has two diametrically opposed peripheral portions cut and bent downwardly and outwardly so that a pair of retentive lips 15, 15 are provided on the periphery of the disk 11 in diametrically opposed relation to each other. The upcoupling means 10 also has a axle 13 provided centrally on the lower side of the disk 11. The disk 11 is rotatably mounted on the female member 1 in such a manner that the retentive lips 15, 15 and the peripheral edge 11' of the disk 11 loosely hold the peripheral edge of the circular aperture 3 of the female member 1 therebetween and the axle 13 of the disk 11 is pivotally mounted in situ on the female member 1. As better shown in FIG. 9, the disk 11 has on its lower side the arcuate cam ridges 16, 16, each of which has its concave side 16*s* directed inwardly of the disk 11 or towards the axle 13 and has its one end 16*e* disposed closer to the axle 13 than the other end 16*e'*. The arcuate cam ridges 16, 16 are symmetrical to each other across the axle 13. When the uncoupling means 10 is rotatably mounted on the female member 1, the pins 9, 9 of the resilient arms 4, 4 are urged under the resiliency of the resilient arms 4, 4 into sliding engagement with the concave sides 16*s*, 16*s* of the respective arcuate cam ridges 16, 16 so that rotation of the disk 11 by the angle of 90 degrees anti-clockwise (as viewed in FIG. 3) causes the resilient arms 4, 4 angularly move toward each other against the their own resiliency.

As better shown in FIGS. 10 through 13, the male member 20 includes an attachment plate 22 and a tongue-shaped presser 21 pivotally mounted on the attachment plate 22 by means of aligned pins 23, 23 provided on one end of and on the opposite sides of the tongue-shaped presser 21.

Figure 11:
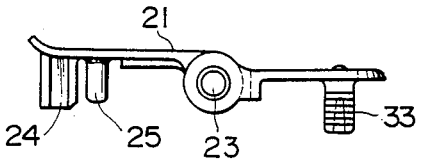
FIG. 11 is a side elevational view of FIG. 10.
Figure 12:
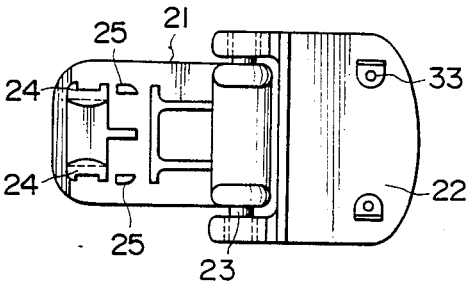
FIG. 12 is a bottom view of FIG. 10.
Figure 13:
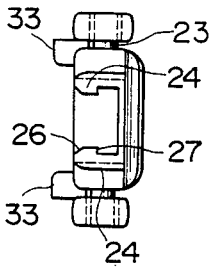
FIG. 13 is a front elevational view of FIG. 10.
Figure 14:
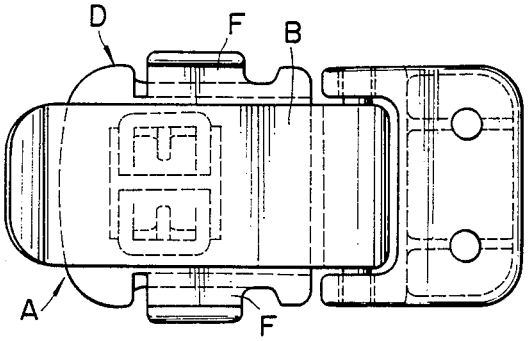
FIG. 14 PRIOR ART
FIG. 14 is a plan view of a buckle according to a prior art, showing male and female members in a coupled posture.
Figure 15:
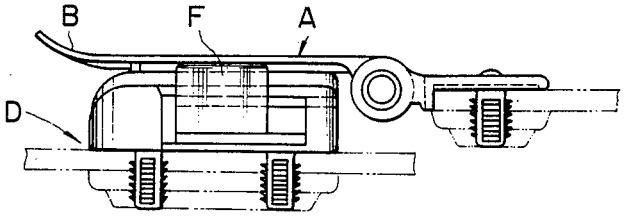
FIG. 15 PRIOR ART
FIG. 15 is a side elevational view of FIG. 14.
Figure 16:
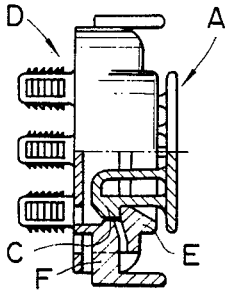
FIG. 16 PRIOR ART
FIG. 16 is a front elevational view, partly in cross-section, of FIG. 14.

As shown in FIGS. 11 and 12, the tongue-shaped presser 21 has on its lower side a pair of engaging legs 24, 24 and a pair of resilient pieces 25, 25, all integrally formed to the tongue-shaped presser 21. As better shown in FIG. 12, the two engaging legs 24, 24 are separated, laterally of the tongue-shaped presser 21, from each other; while the two resilient pieces 25, 25 are, similarly, separated, laterally of the tongue-shaped presser 21, from each other. The two resilient pieces 25, 25 are disposed adjacent to and extend longitudinally of the tongue-shaped presser 21. As shown in FIG. 13, each of the engaging legs 24, 24 has at its distal end a beveled surface 26 and at the middle on its inner or opposite side, a stepped portion 27 for engagement with the hook-shaped engaging means 6. As shown in FIGS. 3 and 13, the attachment plate 22 is provided at its lower side with a pair of studs 33, 33. As better shown in FIG. 2, the studs 33, 33 pass through a fabric piece 34 first and then are secured at their distal ends to a base plate 35, so that the male member 20 is firmly attached to the fabric piece 34.

Coupling and uncoupling operation of the male member 20 and female member 1 is now described hereinbelow.

For coupling the male member 20 with the female member 1, the tongue-shaped presser 21 of the male member 20 is caused to pivot on the pins 23, 23 into pressing engagement with the female member 1, thereby forcing the engaging legs 24, 24 and the resilient pieces 25, 25 of the former through the rectangular aperture 2 of the latter into the respective spaces 8, 8, whereupon the engaging legs 26 come into snapping engagement with the respective hook-shaped engaging means 6, 6 under the resiliency of the resilient arms 4, 4, and the resilient pieces 25, 25 comes into confronting relation to the respective abutment portions 7, 7.

For uncoupling the male member 20 from the female member 1, a grip knob 12 is gripped and turned by fingers for rotation of the uncoupling means 10. Rotation of the uncoupling means 10 by the angle of 90 degrees anti-clockwise (as viewed in FIG. 3) would cause the resilient arms 4, 4 angularly move around their proximal ends 5, 5 towards each other against their own resiliency thanks to the pins 9, 9, of the respective arms 4, 4, sliding along the concave sides 16*s*, 16*s* of the respective arcuate cam ridges 16, 16 of the uncoupling means 10. As a result, the hook-shaped engaging means 6, 6 provided on the inner side of the resilient arms 4, 4, come out of engagement with the stepped portions 27, 27 of the respective engaging legs 24, 24, and, at the same moment, the abutment portions 7, 7 also provided on the inner side of the arms, 4, 4 compress the resilient pieces 25, 25 against the resiliency thereof, so that, eventually, the tongue-shaped presser 21 of the male member 20 springs apart from the female member 1 automatically in a snap action under the resiliency of the resilient pieces 25, 25.

Release of fingers from the grip knob 12, 12 would cause the resilient arms 4, 4 spring back under their own resiliency whereby the uncoupling means 10 turns back to the orginal position indicated in FIG. 3 and the hook-shaped engaging means 6, 6 and the abutment portions 7, 7 are restored into their respective original positions so that the female member 1 is now ready for next coupling with the male member 20.

Figure 17:
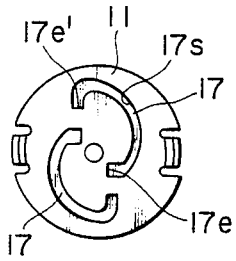
FIG. 17 is a view similar to FIG. 9, but showing uncoupling means of a buckle according to another embodiment of the present invention.

For the arcuate cam ridges 16, 16 mentioned above, a pair of arcuate cam grooves 17, 17 may substitute for engagement with the pins 9, 9 provided at the free ends 4', 4' of the arms 4, 4. FIG. 17 shows a modification wherein a pair of arcuate cam grooves 17, 17 are formed in the lower side of the disk 11, each arcuate cam groove 17 having its concave side 17*s* directed outwardly of the disk (11) and having its one end 17*e* disposed closer to the center of the disk than the other end 17*e'*, the arcuate grooves 17, 17 being symmetrical to each other across the center of the disk 11. The pins 9, 9 of the resilient arms 4, 4 are urged under the resiliency of the resilient arms 4, 4 into sliding engagement with the concave side 17*s*, 17*s* of the respective arcuate cam grooves 17, 17.

According to the present invention, since the grip knob of the the uncoupling means are mounted on upper side of the female member of the buckle, this advantageously facilitates the operation of uncoupling the male member from the female member even if the underlying fabric piece is so soft that the female member is partly embedded in such a soft fabric piece or even if the female member is very thin.

Obviously, many modifications and variations of the present invention are possible in the light of the above teachings. It is therefore to be understood that within the scope of the appended claims, the invention may be practiced otherwise than as specifically described.

What is claimed is:

1. A buckle comprising: a male member having a tongue-shaped presser having on its lower side a pair of engaging legs; a female member being in the form of a case and including in its upper side an aperture for insertion of the engaging legs, and a pair of transversely spaced resilient arms formed integrally to one end of the female member and terminating in free ends for angular movement aroung their proximal ends against their own resiliency, the arms having engaging means for engagement with the engaging legs when the engaging legs are forced through an aperture; and an uncoupling means for bringing the engaging means out of engagement with the engaging legs, the uncoupling means having a disk rotatably mounted on the upper side of the female member; the uncoupling means further including linking means for so operatively linking the disk and the resilient arms that the rotation of the disk causes the resilient arms angularly move against their own resiliency, thereby bringing the engaging means out of engagement with the engaging legs.

2. A buckle according to claim 1, wherein the linking means comprises cam means provided on the lower side of the disk for engagement with the resilient arms.

3. A buckle according to claim 1, wherein the resilient arms includes a pair of protuberances provided on their respective arms, the linking means comprising cam means provided on the lower side of the disk for engagement with the protuberances of the resilient arms.

4. A buckle according to claim 3, wherein the engaging means are provided on the middles of the respective arms and the protuberances are provided on the free ends of the respective arms.

5. A buckle according to claims 3, where the protuberances comprise a pair of pins provided on their respective arms.

6. A buckle according to claim 5, wherein the cam means comprises a pair of arcuate cam ridges provided on the lower side of the disk, each arcuate cam ridge having its concave side directly inwardly of the disk and having its one end disposed closer to a center of the disk than the other end, the arcuate cam ridges being symmetrical to each other across the center of the disk, the pins of the resilient arms being urged under the resiliency of the resilient arms into sliding engagement with the concave sides of the respective arcuate cam ridges.

7. A buckle according to claim 5, wherein the cam means comprises a pair of arcuate grooves formed in the lower side of the disk, each arcuate groove having its concave side directed outwardly of the disk and having its one end disposed closer to a center of the disk than the other end, the arcuate grooves being symmetrical to each other across the center of the disk, the pins of the resilient arms being urged under the resiliency of the resilient arms into sliding engagement with the concave side of the respective arcuate grooves.

8. A buckle according to claim 1, wherein the female member has another aperture in the upper side thereof, the uncoupling means further including a pair of retentive lips provided on the periphery of the disk in diametrically opposed relation to each other and an axle provided centrally on the lower side of the disk, the retentive lips and the peripheral edge of the disk loosely holding the peripheral edge of said another aperture of the female member therebetween and the axle being pivotally mounted in situ on the female member.

9. A buckle according to claim 1, wherein the uncoupling means further includes a grip knob provided on the upper side of the disk.

* * * * *